US007278353B2

(12) United States Patent
Langan et al.

(10) Patent No.: US 7,278,353 B2
(45) Date of Patent: Oct. 9, 2007

(54) REACTIVE SHAPED CHARGES AND THERMAL SPRAY METHODS OF MAKING SAME

(75) Inventors: Timothy Langan, Catonsville, MD (US); Michael A. Riley, Towson, MD (US); W. Mark Buchta, Ellicott City, MD (US)

(73) Assignee: Surface Treatment Technologies, Inc., Halethorpe, MD (US)

( * ) Notice: Subject to any disclaimer, the term of this patent is extended or adjusted under 35 U.S.C. 154(b) by 147 days.

(21) Appl. No.: 10/839,638

(22) Filed: May 5, 2004

(65) Prior Publication Data

US 2005/0011395 A1 Jan. 20, 2005

Related U.S. Application Data

(60) Provisional application No. 60/478,761, filed on Jun. 16, 2003, provisional application No. 60/473,509, filed on May 27, 2003.

(51) Int. Cl.
*F42B 1/032* (2006.01)

(52) U.S. Cl. ..... 102/306; 102/307; 102/476; 427/455

(58) Field of Classification Search ..... 102/306, 102/307, 308, 309, 310, 475, 476, 275.11, 102/205; 149/14, 15, 16, 37; 428/607, 615, 428/548; 427/455; 89/36.02, 36.17
See application file for complete search history.

(56) References Cited

U.S. PATENT DOCUMENTS 3,135,205 A 6/1964 Zwicky
3,235,005 A 2/1966 Delacour
3,726,643 A 4/1973 Merzhanov et al.
4,161,512 A 7/1979 Merzhanov et al.
4,431,448 A 2/1984 Merzhanov et al.
4,498,367 A 2/1985 Skolnick et al.
4,557,771 A 12/1985 Bencz et al.
4,710,348 A 12/1987 Brupbacher et al.
4,766,813 A 8/1988 Winter et al.
4,836,982 A 6/1989 Brupbacher et al.
4,915,905 A 4/1990 Kampe et al.
4,917,964 A 4/1990 Moshier et al.
4,958,569 A 9/1990 Mandigo
5,015,534 A 5/1991 Kampe et al.
5,090,324 A 2/1992 Bocker et al.
5,098,487 A * 3/1992 Brauer et al. ..... 148/432
5,119,729 A 6/1992 Nguyen
5,175,391 A 12/1992 Walters et al.
5,331,895 A * 7/1994 Bourne et al. ..... 102/307

(Continued)

FOREIGN PATENT DOCUMENTS

DE 3218205 A1 * 10/1985

(Continued)

*Primary Examiner*—James S. Bergin
(74) *Attorney, Agent, or Firm*—Alan G. Towner, Esq.; Pietragallo Bosick & Gordon, LLP

(57) ABSTRACT

Shaped charge liners are made of reactive materials formed by thermal spray techniques. The thermally sprayed reactive shaped charge materials have low porosity and high structural integrity. Upon detonation, the reactive materials of the shaped charge liner undergo an exothermic reaction that raises the temperature and the effectiveness of the liner.

33 Claims, 6 Drawing Sheets

U.S. PATENT DOCUMENTS 5,413,048 A 5/1995 Werner et al.
5,523,048 A * 6/1996 Stinson et al. ..... 419/28
5,538,795 A 7/1996 Barbee, Jr. et al.
5,547,715 A 8/1996 Barbee, Jr. et al.
5,656,791 A 8/1997 Reese et al.
5,859,383 A * 1/1999 Davison et al. ..... 102/307
5,939,664 A 8/1999 Kapoor
6,012,392 A 1/2000 Norman et al.
6,021,714 A 2/2000 Grove et al.
6,152,040 A 11/2000 Riley et al.
6,446,558 B1 9/2002 Peker et al.
6,530,326 B1 3/2003 Wendt, Jr. et al.
6,534,194 B2 3/2003 Weihs et al.
6,564,718 B2 5/2003 Reese et al.
6,588,344 B2 7/2003 Clark et al.
6,596,101 B2 7/2003 Weihs et al.
6,634,300 B2 10/2003 Reese et al.
6,655,291 B2 12/2003 Pratt et al.
6,736,942 B2 5/2004 Weihs et al.
6,863,992 B2 3/2005 Weihs et al.
6,881,284 B2 * 4/2005 Makowiecki et al. .... 149/109.6
6,962,634 B2 * 11/2005 Nielson et al. ..... 149/19.3
6,991,855 B2 1/2006 Weihs et al.
6,991,856 B2 1/2006 Weihs et al.
2001/0046597 A1 11/2001 Weihs et al.
2002/0182436 A1 12/2002 Weihs et al.
2003/0012678 A1 * 1/2003 Sherman ..... 419/66
2003/0164289 A1 9/2003 Weihs et al.
2004/0060625 A1 * 4/2004 Barbee et al. ..... 149/15
2005/0051607 A1 3/2005 Wang et al.
2005/0082343 A1 4/2005 Wang et al.
2005/0136270 A1 6/2005 Besnoin et al.
2006/0068179 A1 3/2006 Weihs et al.

FOREIGN PATENT DOCUMENTS

EP 0694754 A2 * 1/1996

* cited by examiner

APS 329 AS COM

TSPW-13 AS

REACTIVE SHAPED CHARGES AND THERMAL SPRAY METHODS OF MAKING SAME

CROSS-REFERENCE TO RELATED APPLICATIONS

This application claims the benefit of U.S. Provisional Patent Application Ser. No. 60/473,509 filed May 27, 2003, and U.S. Provisional Patent Application Ser. No. 60/478,761 filed Jun. 16, 2003, which are incorporated herein by reference.

GOVERNMENT CONTRACT

The United States Government has certain rights to this invention pursuant to Contract No. N68936-03-C-0019 awarded by the Naval Warfare Center.

FIELD OF THE INVENTION

The present invention relates to shaped charges, and more particularly relates to reactive shaped charges made by a thermal spray process.

BACKGROUND INFORMATION

Shaped charges comprising a metal liner and an explosive backing material are used for various applications such as warheads, oil well bores, mining and metal cutting. Examples of shaped charge warheads are disclosed in U.S. Pat. Nos. 4,766,813, 5,090,324, 5,119,729, 5,175,391, 5,939,664, 6,152,040 and 6,446,558. Examples of shaped charges used for perforating operations in oil and gas wells are disclosed in U.S. Pat. Nos. 4,498,367, 4,557,771, 4,958,569, 5,098,487, 5,413,048, 5,656,791, 5,859,383, 6,012,392, 6,021,714, 6,530,326, 6,564,718, 6,588,344, 6,634,300 and 6,655,291. The use of shaped charges in rock quarries is disclosed in U.S. Pat. No. 3,235,005 to Delacour.

The present invention has been developed in view of the foregoing.

SUMMARY OF THE INVENTION

The present invention provides a method of producing reactive shaped charges made of reactive materials formed by a thermal spray process. Reactive components are thermally sprayed together and/or sequentially to build up a "green body" comprising the reactive components. The resultant reactive material has high density with commensurate mechanical strengths that are suitable for structural applications. Although a portion of the reactive components may react with each other during the thermal spraying operation, at least a portion (e.g., 1-99 weight percent) of the components remain unreacted in the green body. The reactive material may subsequently be reacted by any suitable initiation technique, such as a localized heat source or bulk heating of the material, e.g., by high strain rate deformation (explosive shock heating). An embodiment of the invention also provides reaction rate control mechanisms within the thermally sprayed structure through the use of non-reactive intermediate layers that can be placed between the reactive layers. These layers can also be placed on the outside of the thermally sprayed body to protect the body from premature reactions caused by excessive force or high temperature.

An aspect of the present invention is to provide a method of making a reactive shaped charge liner by thermal spraying reactive materials. The method includes simultaneous or sequential thermal spraying of reactive components to build up a shaped charge green body of the reactive material.

Another aspect of the present invention is to provide a reactive shaped charge liner comprising reactive material including thermally sprayed reactive components.

A further aspect of the present invention is to provide a method of initiating reaction of a thermally sprayed reactive shaped charge material by high strain rate deformation.

These and other aspects of the present invention will be more apparent from the following description.

DETAILED DESCRIPTION

Figure 1:
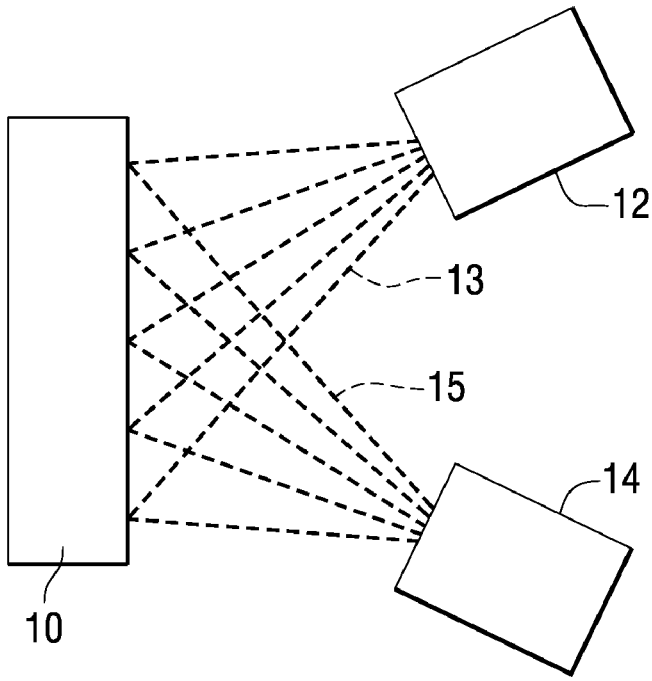
FIG. 1 is a partially schematic illustration of a thermal spray process for making a reactive shaped charge liner utilizing two separate sources of reactive components in accordance with an embodiment of the present invention.

The present invention utilizes a thermal spray process to produce reactive materials in the form of shaped charge liners. As used herein, the term "thermal spray" includes processes such as flame spraying, plasma arc spraying, electric arc spraying, high velocity oxy-fuel (HVOF) deposition cold spraying, detonation gun deposition and super detonation gun deposition, as well as others known to those skilled in the art. Source materials for the thermal spray process include powders, wires and rods of material that are fed into a flame where they are partially or fully melted. When wires or rods are used as the feed materials, molten stock is stripped from the end of the wire or rod and atomized by a high velocity stream of compressed air or other gas that propels the material onto a substrate or workpiece. When powders are used as the feed materials, they may be metered by a powder feeder or hopper into a compressed air or gas stream that suspends and delivers the material to the flame where it is heated to a molten or semi-molten state and propelled to the substrate or workpiece. A bond may be produced upon impact of the thermally sprayed reactive components on the substrate. As the molten or semi-molten plastic-like particles impinge on the substrate, several bonding mechanisms are possible. Mechanical bonding may occur when the particles splatter on the substrate. The particles may thus mechanically interlock with other deposited particles. In addition, localized diffusion or limited alloying may occur between the adjacent thermally sprayed materials. In addition, some bonding may occur by means of Van der Waals forces. In the current case of forming a body of reactive materials, the high temperature impact may also result in chemical bonding of the powders.

The present thermally sprayed reactive materials comprise at least two reactive components. As used herein, the term "reactive components" means materials that exothermically react to produce a sufficiently high heat of reaction. Elevated temperatures of at least 1,000° C. are typically achieved, for example, at least 2,000° C. In one embodiment, the reactive components may comprise elements that exothermically react to form intermetallics or ceramics. In this case, the first reactive component may comprise, for example, Ti, Ni, Ta, Nb, Mo, Hf, W, V, U and/or Si, while the second reactive component may comprise Al, Mg, Ni, C and/or B. Typical materials formed by the reaction of such reactive components include $TiAl_x$ (e.g., TiAl, $TiAl_3$, $Ti_3Al$), NiAl, $TaAl_3$, $NbAl_x$, SiAl, TiC, $TiB_2$, VC, WC and VAl. Thermite powders may also be suitable. In this case, one of the reactive components may comprise at least one metal oxide selected from $Fe_xO_y$, $Ni_xO_y$, $Ta_xO_y$, $TiO_2$, $CuO_x$ and $Al_2O_3$, and another one of the reactive components may comprise at least one material selected from Al, Mg, Ni and $B_4C$. More than two reactive components may be used, e.g., Al/Ni/NiO, Ni/Al/Ta, etc.

By proper alloy selection, it is possible to form alloy layers that will chemically equal an unreacted intermetallic compound. By forming these structures by thermal spray techniques, the unreacted body is a substantially fully dense solid structure complete with mechanical properties that permit its use as a load bearing material. Under proper shock conditions (explosive or other), the materials undergo an exothermic intermetallic reaction. These reactive bodies differ from compressed powder reactions because there is substantially no impurity outgassing. In addition, pressed powder compositions tend to rapidly disperse into powders after shock initiation. They also differ from reactive metals like zirconium because the entire body reaches its peak exotherm, not just the exposed edges. This permits the fragmented sections of the body to maintain thermal output levels much longer than either powder reactants or pyrophoric metals. Given the ability to control self-propagating reactions via the fanning process, a great degree of tailorability may be achieved with the present reactive materials.

FIG. 1 illustrates a thermal spray process that may be used to form reactive shaped charge liners in accordance with an embodiment of the present invention. A substrate 10 is placed in front of a first thermal spray gun 12 and a second thermal spray gun 14. The first thermal spray gun 12 may be used to thermally spray one reactive component 13 of the reactive material. The second thermal spray gun 14 may be used to spray another reactive component 15 of the reactive material. The thermally sprayed materials 13 and 15 build up on the surface of the substrate 10. More than two thermal spray guns may be used in this process.

Figure 3:
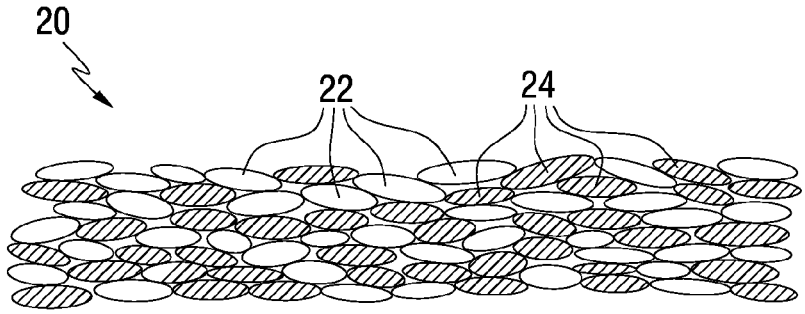
FIG. 3 schematically illustrates a thermally sprayed reactive material for use as a reactive shaped charge liner comprising a mixture of deposited particulates of different reactive components in accordance with an embodiment of the present invention.

In the embodiment shown in FIG. 1, both thermal spray guns 12 and 14 may be used simultaneously to produce a reactive material comprising intermixed particles of the first and second reactive components. Such a thermally sprayed particulate mixture is shown in FIG. 3, as more fully described below. Alternatively, the first and second thermal spray guns 12 and 14 may be operated sequentially in order to build up alternating layers of the first and second reactive materials. An example of the deposition of alternating layers of the first and second reactive components in shown in FIG. 4. As another alternative, one or both of the thermal spray guns 12 and 14 shown in FIG. 1 may deliver a mixture of both of the reactive component materials to the substrate 10.

Figure 2:
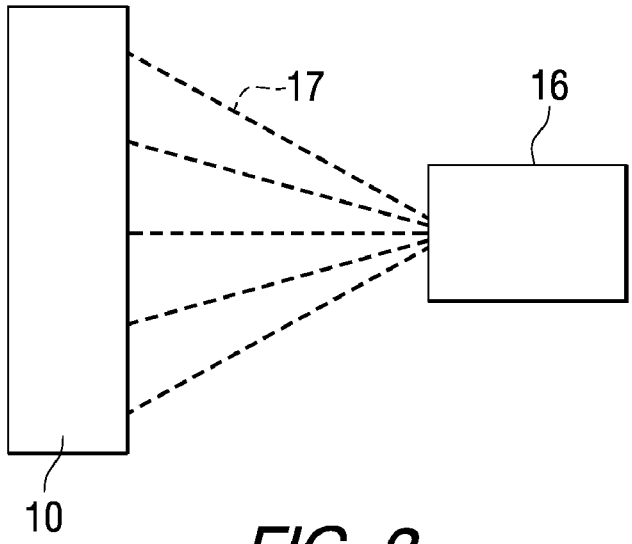
FIG. 2 is a partially schematic illustration of a thermal spray process for making a reactive shaped charge liner utilizing a single source comprising a mixture of reactive components in accordance with another embodiment of the present invention.

FIG. 2 illustrates a thermal spray process in accordance with another embodiment of the present invention. In this embodiment, a single thermal spray gun 12 is used to deliver a mixture of reactive materials 17 to the surface of the substrate 10. For example, a powder mixture comprising particulates of both reactive components of the reactive material may be fed through the thermal spray gun 16. Alternatively, wires or rods of the different reactive component materials may be simultaneously fed through the thermal spray gun 16. As another alternative, powders of the reactive components may be sequentially fed through the thermal spray gun 16 in an alternating manner. Also, wires or rods of the different reactive component materials may alternately be fed through the thermal spray gun 16.

FIG. 3 schematically illustrates a thermally sprayed reactive material 20 comprising a mixture of deposited particles of a first reactive component 22 and a second reactive component 24. The thermally sprayed reactive material 20 typically has a density of at least 90 percent of the theoretical density of the material, i.e., has a porosity of less than 10 volume percent. Preferably, the density of the thermally sprayed reactive material has a density of at least 94 or 95 percent, more preferably at least 97 or 98 percent.

To achieve full density of the body, the process can also thermally deposit reactive polymer matrices such as fluoropolymers to fill in the voids. Upon shock initiation, these polymers will be consumed and act as an oxidizer to increase the thermal energy generated from the reaction.

Figure 4:
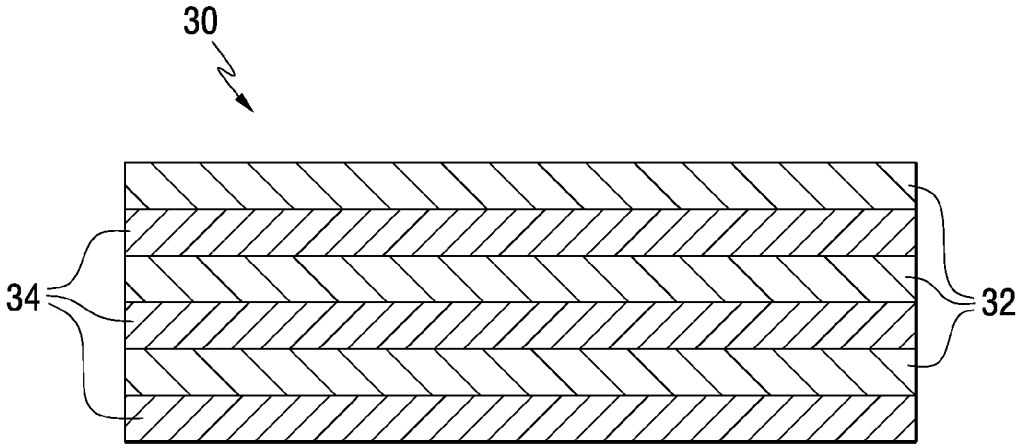
FIG. 4 schematically illustrates a reactive material for use as a reactive shaped charge liner comprising alternating thermally sprayed layers of reactive components in accordance with another embodiment of the present invention.

FIG. 4 schematically illustrates a thermally sprayed reactive material 30 comprising alternating layers of a first thermally sprayed reactive component material 32 and a second thermally sprayed reactive component material 34.

Figure 5:
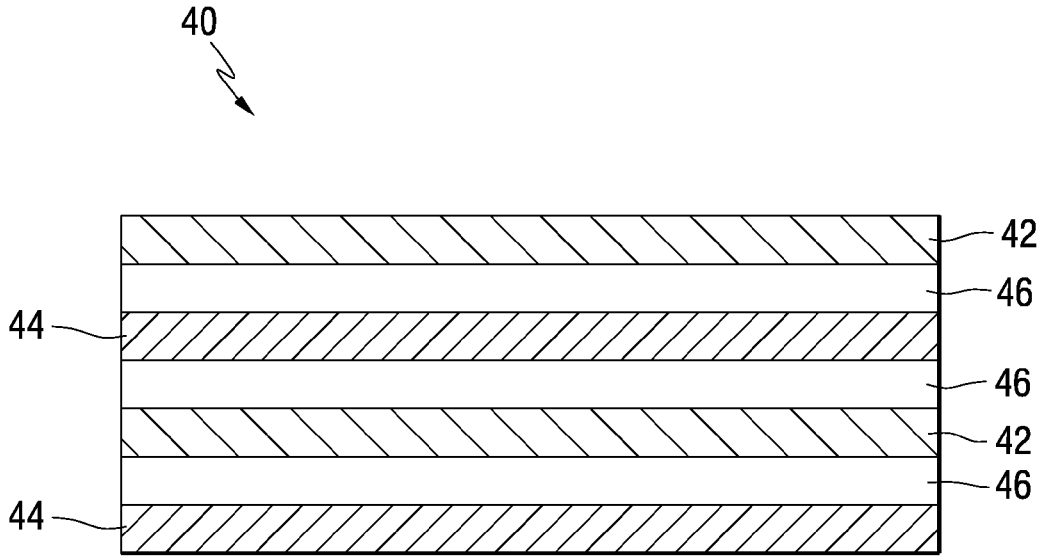
FIG. 5 schematically illustrates a reactive material for use as a reactive shaped charge liner comprising thermally sprayed layers of reactive components separated by layers of inert material in accordance with a further embodiment of the present invention.

FIG. 5 illustrates a reactive material 40 comprising thermally sprayed layers of first and second reactive components 42 and 44, separated by layers of inert material 46. The inert material layers 46 may comprise any suitable material such as glasses and ceramics, and may be thermally sprayed, or may be deposited by any other suitable technique.

Figure 6:
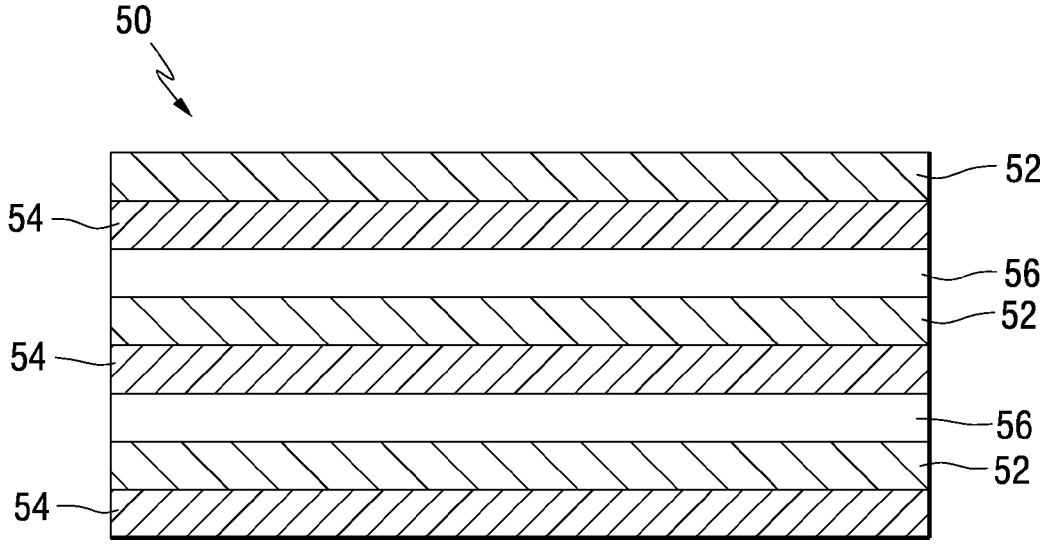
FIG. 6 schematically illustrates a reactive material for use as a reactive shaped charge liner comprising pairs of thermally sprayed reactive component layers separated by layers of inert material in accordance with another embodiment of the present invention.

FIG. 6 illustrates a reactive material 50 comprising pairs of thermally sprayed reactive component layers 52 and 54, separated by layers of inert material 56.

The thermally sprayed reactive components are deposited on the substrate at a rate of at least 0.01 mm per hour. For example, the thermally sprayed reactive components are deposited on the substrate at a rate of at least 0.1 mm per hour, preferably at a rate of at least 1 mm per hour.

Figure 7:
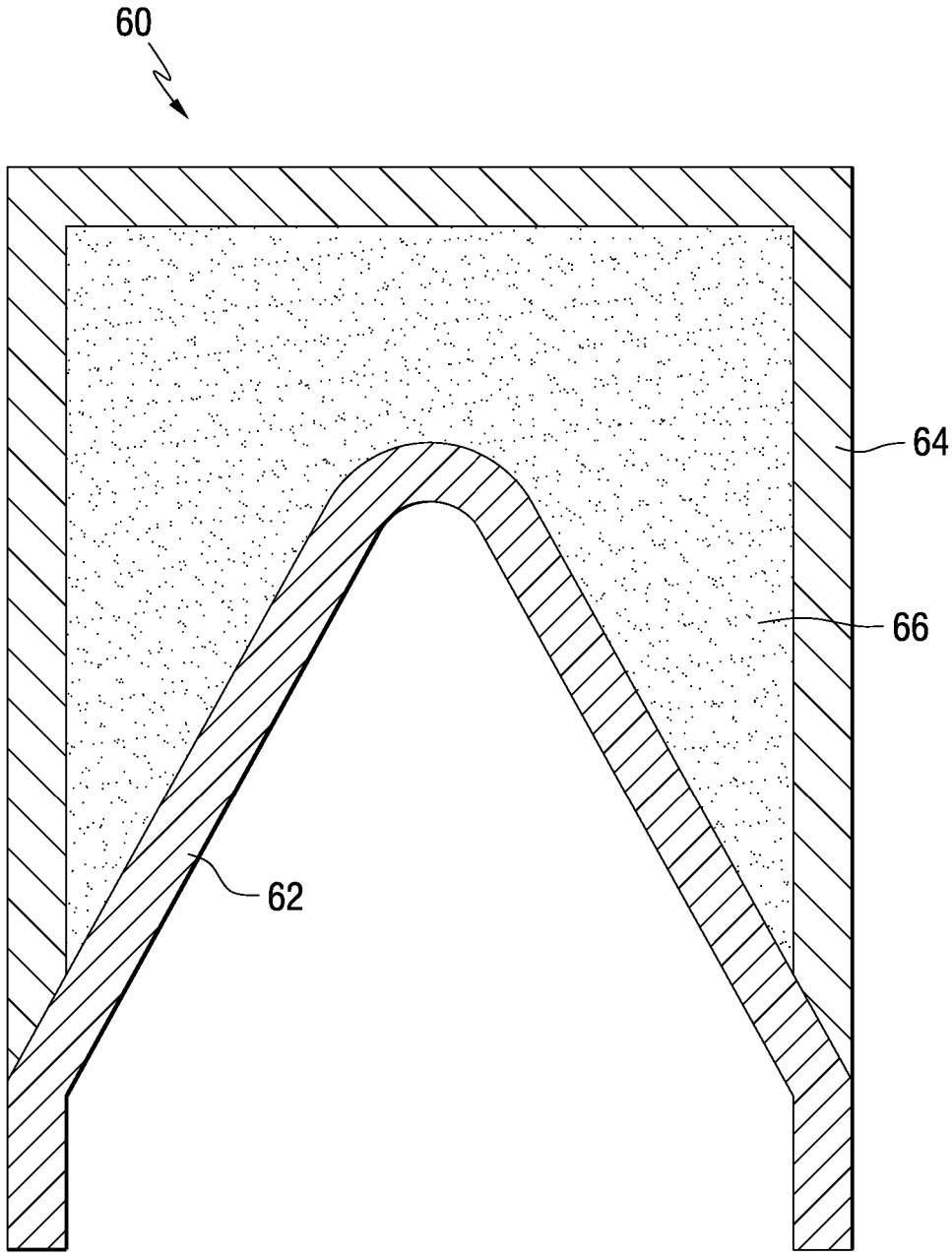
FIG. 7 is a partially schematic cross-sectional view of a reactive shaped charge including a thermally sprayed reactive material in accordance with an embodiment of the present invention.

FIG. 7 is a sectional view of a shaped charge 60 including a thermally sprayed reactive material shaped charge liner 62 in accordance with the present invention. The shaped charge 60 includes a casing 64 made of any suitable material such as aluminum, steel or fiber-wrap composite filled with an explosive material 66 made of any suitable material such as PETN, Octol or C-4.

In the embodiment shown in FIG. 7, the reactive shaped charge liner 62 is substantially cone-shaped. The height of such a cone-shaped liner typically ranges from about 1 to about 100 cm. The diameter of the cone-shaped liner, measured at its base, typically ranges from about 1 to about 100 cm. Although a cone-shaped liner is shown in FIG. 7, other shapes may be used, such as spheres, hemispheres, cylinders, tubes, lines, I-beams and the like.

The following examples are intended to illustrate various aspects of the present invention, and are not intended to limit the scope of the invention. In the following examples, duplicates of the following shaped charge liners were fabricated:

Copper liners—100% conical copper liners were fabricated as control articles.

Copper base/PVD coating—copper liners with reduced wall thickness coated with Ni and Al via magnetron plasma vapor deposition sputtering, total thickness approximately that of the control copper articles.

Copper base/plasma sprayed coating—reduced thickness copper liners with a vacuum plasma spray (VPS) Ni and Al coating, total thickness approximately that of the control articles.

Plasma sprayed liners—100% Ni/Al liner made via VPS on a cone-shaped mandrel with subsequent removal of the mandrel, total thickness approximately that of the control articles.

Copper base/thermal spray coating—reduced thickness copper liners with a Ni/Al coating applied with a combination of powder and wire thermal spray, total thickness approximately that of the control articles.

Thermal spray liner—100% Ni/Al liner made via powder and wire thermal spray on a cone-shaped mandrel with subsequent removal of the mandrel, total thickness approximately that of the control articles.

EXAMPLE 1

Copper Base/Plasma Sprayed Coatings: HTC-1, HTC-2

In this example a copper cone liner was coated with Al and Ni using the vacuum plasma spray using the (VPS) process. The copper cone liners (0.024-inch wall thickness) were machined. These liners were attached to a rotating shaft in the VPS chamber. This shaft also translated horizontally below the plasma spray gun. After evacuating the chamber and backfilling to a partial pressure of argon, coating was applied to the rotating/translating liner. Two types of coating were applied. One was a composite comprising a blend of Ni and Al powders in a 1:1 atomic ratio. This was fed to the plasma gun via a single powder hopper and injector. The second coating type was a layered structure achieved by using separate hoppers and injectors for the Ni and Al powders. Although the powders were simultaneously injected into the plasma flame, it was believed that the density differences resulted in disparate particle velocities. This phenomenon, in conjunction with the rotational and planar motion of the liner, created spiral layers of Ni and Al.

Sample HTC-1 was the composite coating. The as-sprayed coating thickness was approximately 0.032-inch. Sample HTC-2 was the co-sprayed, layered coating. The as-sprayed coating thickness was approximately 0.054-inch.

For machining and polishing, HTC-1 and HTC-2 were placed on a lathe-mounted mandrel. Final wall thickness measurements were 0.048-0.050-inch for HTC-1 and approximately 0.054-inch for HTC-2.

EXAMPLE 2

Plasma Sprayed Liners: FTC-1, FTC-2

These samples were also produced using VPS but, instead of coating on a base copper liner, monolithic Al/Ni cones were fabricated by spraying on a mandrel.

Figure 8:
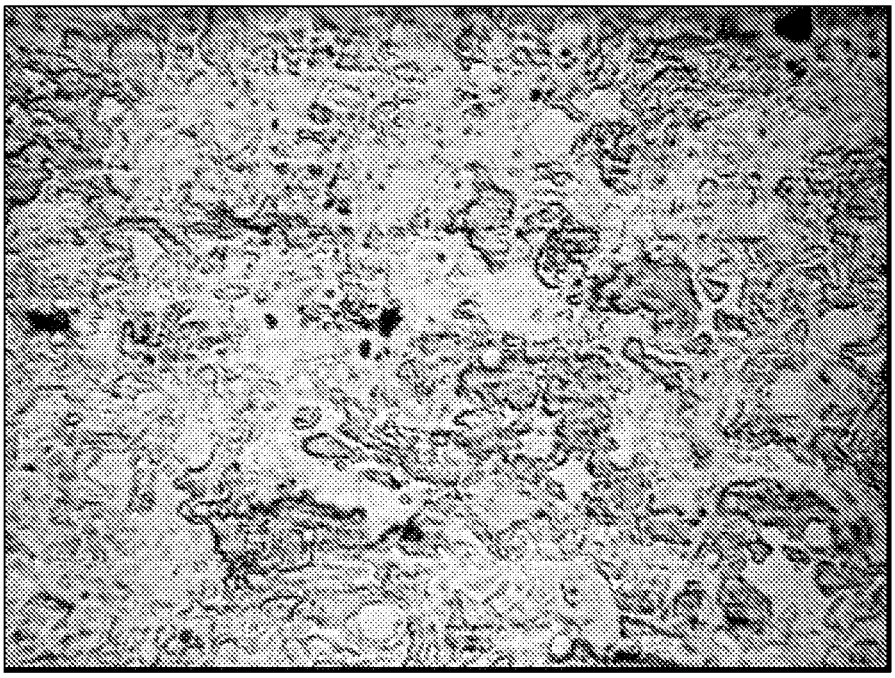
FIG. 8 is a photograph of a thermally sprayed reactive shaped charge liner material after thermal spraying.

Sample FTC-1 was made with the composite powder blend, building to a thickness of approximately 0.092-inch. FTC-2 utilized the co-spray, layered method and the as-sprayed thickness was approximately 0.065-inch. A photograph of the FTC-2 as-sprayed material is shown in FIG. 8.

Figure 9:
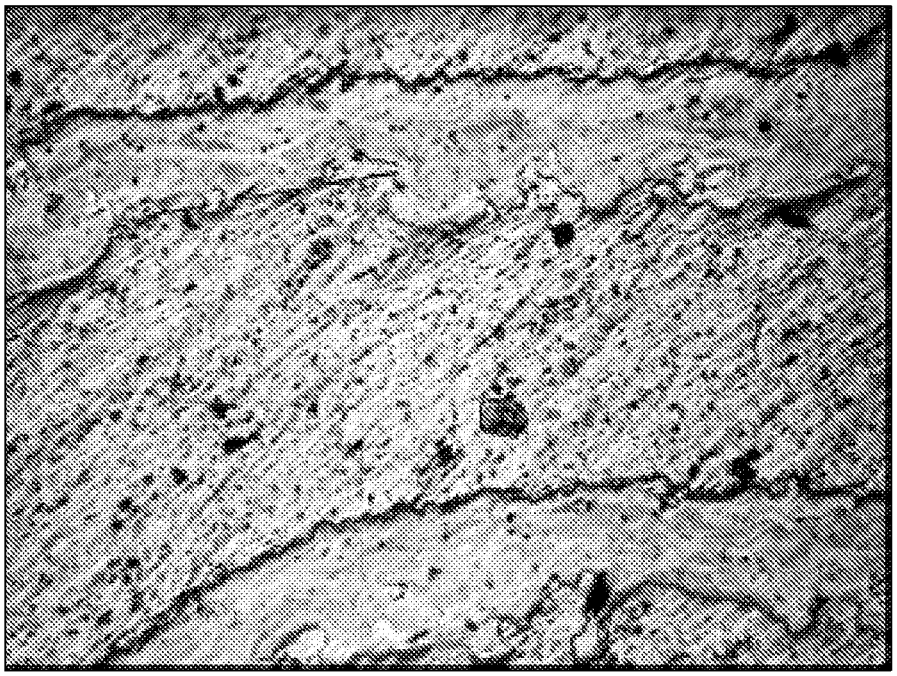
FIG. 9 is a photograph of a thermally sprayed reactive shaped charge liner material after surface machining.

Finished thickness for FTC-1 was approximately 0.045-inch at the skirt and 0.065-inch in the conical section. Final thickness for FTC-2 was approximately 0.040-0.045-inch. A photograph of the FTC-1 material after machining is shown in FIG. 9.

EXAMPLE 3

Copper Base/Thermal Spray Coating: TSPW-4

Sample TSPW-4 was fabricated by depositing a Ni/Al coating on a copper cone liner using a combination of conventional thermal spray techniques—combustion powder and combustion wire. TSPW-4 was made by spraying alternating layers of aluminum wire and nickel powder on a rotating substrate. The Al wire (0.125-inch diameter) was applied with a Metco 12E combustion gun and the Ni powder (spherical, −325 mesh) with a Eutectic Teradyn 2000 gun. The fuel for both methods was a mixture of acetylene and oxygen gases. The guns were hand-held by separate operators and the coatings were applied in alternating, short-duration efforts.

After spraying, TSPW-4 coating thickness was approximately 0.075-inch in the conical section and 0.040-inch at the skirt. A mandrel was used to hold the liner for machining and polishing. After finishing, the coating thickness was approximately 0.043-inch in the conical section and 0.030-inch at the skirt.

EXAMPLE 4

Thermal spray coating: TSPW-8

Sample TSPW-8 was a monolithic liner (no copper cone) fabricated using the thermal spray methods employed for TSPW-4. The alternating Al and Ni layers were applied to a rotating steel mandrel. Wall thickness after coating was approximately 0.062-inch. The liner was removed from the mandrel using a cylindrical tool with a bore diameter slightly larger than the diameter of the mandrel bottom. TSPW-8 was machined and polished, using another mandrel, to a wall thickness of approximately 0.040-inch in the conical section and 0.030-inch at the skirt. The test articles described in the examples above were installed in containers to create shaped charges and underwent detonation testing.

To determine the reactivity and penetration effects. After fabrication, the steel containers were filled with a quantity of A-5 high explosive and the conical liners were pressed into the explosive. The critical factor in shaped charge fabrication is maintaining the axial alignment of the container, liner, detonator and explosive charge. Symmetry around the centerline is required to form a penetration jet of the proper shape and density. Pressing parameters (density, pressure, alignment tolerance, etc.) for these tests conformed to standard industry practice for copper liners.

Figure 10A:
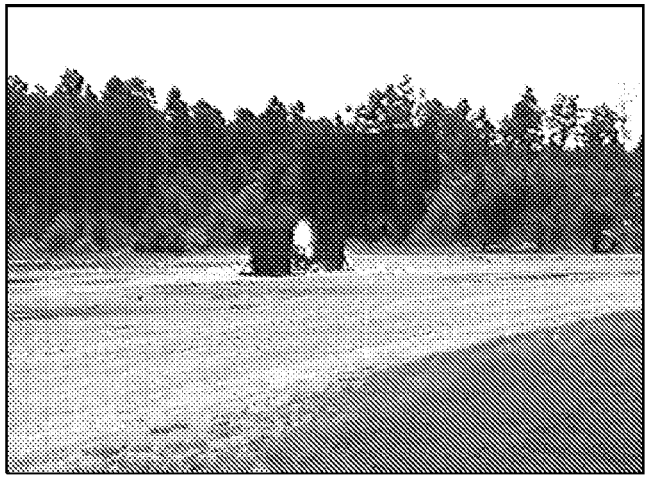
FIGS. 10*a-c* are photographs showing detonation of a reactive shaped charge liner of the present invention.
Figure 10B:
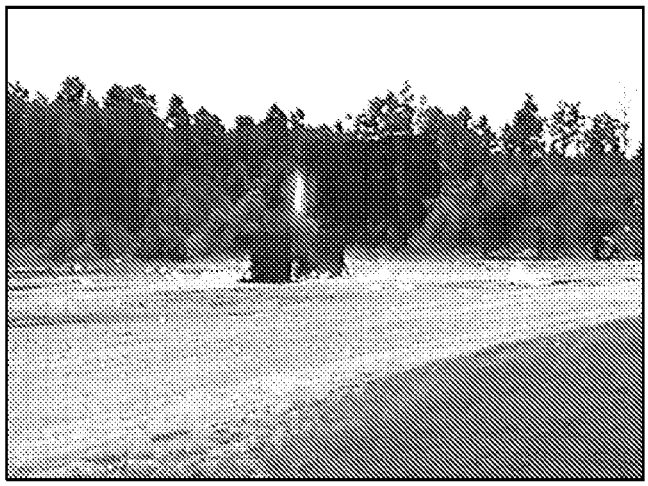
Figure 10C:
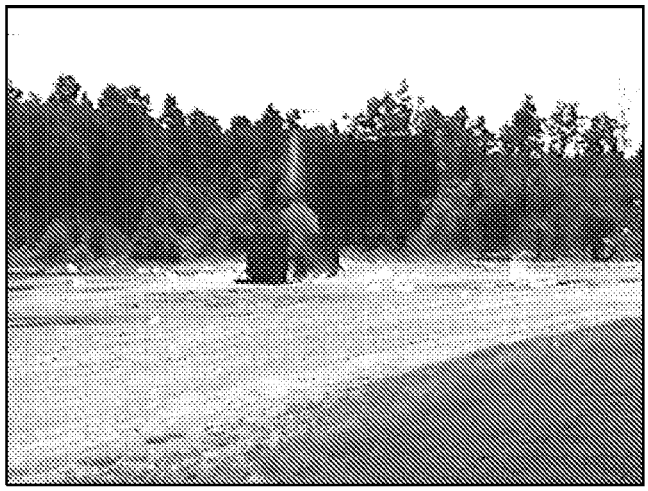

Each shaped charge was tested to determine its ability to penetrate mild, steel plate. Before each test, the underlying ground was leveled and a 12×12×1-inch thick base plate was situated. Several steel target plates, 8×8×1-inch thick, were stacked on the base and checked for level. The detonation assembly was mounted, leveled and taped in place. The results of testing are shown in Table 1. A series of photographs illustrating the detonation of the HTC-2 reactive shaped charge liner is shown in FIGS. 10*a-c*.

TABLE 1

| Sample Type | Sample I.D. | Penetration Depth (# of Plates) | Penetration Volume ($cm^2$) | Comments |
|---|---|---|---|---|
| Full-thickness copper liner | C-1 | 6 | 15.47 | Round hole with raised edge, no flash |
| | C-2 | 4 | 15.07 | Round hole with raised edge, no flash |
| | C-3 | 5 | 15.43 | Round hole with raised edge, no flash |
| VPS composite Ni/Al coating on copper liner | HTC-1 | 4 | 13.62 | No flash, hole similar to C-1 |
| | HTC-2 | 3 | 13.32 | Bright flash, hole more ragged than HTC-1 |
| VPS composite Ni/Al monolith | FTC-1 | 3 | 16.11 | Bright flash, round hole, some evidence of burning |
| | FTC-2 | 3 | 15.05 | Bright flash, round hole similar to C-1 |
| Thermal spray Ni/Al on copper liner | TSPW-4 | 5 | 15.71 | Bright flash, round hole slightly more ragged than C-1 |
| | TSPW-8 | 2 | 15.07 | Similar to TSPW-4 |

The present technique provides for the formation of reactive multi-layer structures via thermal spray processes, including plasma spray, vacuum plasma spray and ambient wire spray forming techniques. By pulsing each reactive material, layers of varying thicknesses can be formed, yet very high-density structures can be formed. The approach allows mechanical strengths of conventional plasma spray metal systems. By the optional use of vacuum plasma spray, the structure can control the buildup of oxide layers that could inhibit the thermal energy of the reaction.

This approach offers a major advantage over vapor deposition or condensation techniques. Plasma spray forming can be rapid and can form large structures. The ability exists to form structures as thick as one-half inch by 12 inches in as little as an hour. The process can be controlled by multi-axis tools, including robotics. The process can be applied onto existing structures, or even on composite lay-ups for additional structural benefits.

Whereas particular embodiments of this invention have been described above for purposes of illustration, it will be evident to those skilled in the art that numerous variations of the details of the present invention may be made without departing from the invention.

What is claimed is:

1. A method of making a reactive shaped charge liner, the method comprising thermally spraying reactive components of a reactive material onto a substrate to form the shaped charge liner comprising the reactive components which are capable of subsequently reacting with each other.

2. The method of claim 1, wherein the thermal spray process comprises flame spraying, plasma arc spraying, electric arc spraying, high velocity oxy-fuel deposition, cold spraying, detonation gun deposition or super detonation gun deposition.

3. The method of claim 1, wherein the reactive components are thermally sprayed onto the substrate at the same time.

4. The method of claim 3, wherein the reactive components are thermally sprayed onto the substrate from different thermal spray sources.

5. The method of claim 3, wherein the reactive components are thermally sprayed onto the substrate from a single thermal spray source.

6. The method of claim 1, wherein the reactive components are thermally sprayed onto the substrate sequentially.

7. The method of claim 6, wherein the reactive components are sprayed onto the substrate from different thermal spray sources.

8. The method of claim 1, further comprising removing the reactive material from the substrate.

9. The method of claim 1, wherein the substrate comprises a mandrel.

10. The method of claim 9, wherein the mandrel is rotated during the thermal spraying.

11. The method of claim 1, wherein the substrate is cooled during the thermal spraying.

12. The method of claim 11, wherein the cooling is achieved by a cooling fluid.

13. The method of claim 12, wherein the cooling fluid is directed against a surface of the substrate upon which the reactive components are thermally sprayed.

14. The method of claim 12, wherein the cooling fluid is directed against a back surface of the substrate opposite from a surface of the substrate upon which the reactive components are thermally sprayed.

15. The method of claim 12, wherein the cooling fluid comprises a gas.

16. The method of claim 1, wherein one of the reactive components comprises at least one element selected from Ni, Ti, Nb, V, Ta, W and Si, and another one of the reactive components comprises at least one element selected from Al, Mg, C and B.

17. The method of claim 1, wherein one of the reactive components comprises at least one metal oxide selected from $Fe_xO_y$, $Ni_xO_y$, $Ta_xO_{y,\ TiO2}$, $Al_2O_3$, and another one of the reactive components comprises at least one material selected from Al, Mg, Ni and $B_4C$.

18. The method of claim 1, wherein one of the reactive components comprises Ni and another one of the reactive components comprises Al.

19. The method of claim 1, wherein the reactive components comprise different metals provided in selected amounts to form an intermetallic comprising the metals upon exothermic reaction of the reactive metal components.

20. The method of claim 19, wherein the intermetallic comprises nickel aluminide and/or titanium aluminide.

21. The method of claim 1, wherein the thermally sprayed reactive components are deposited on the substrate at a rate of at least 0.01 mm per hour.

22. The method of claim 1, wherein the thermally sprayed reactive components are deposited on the substrate at a rate of at least 0.1 mm per hour.

23. The method of claim 1, wherein the thermally sprayed reactive components are deposited on the substrate at a rate of at least 1 mm per hour.

24. The method of claim 19, wherein the reactive components are intermixed within the reactive material.

25. The method of claim 1, wherein the reactive components comprise different layers in the reactive material.

26. The method of claim 25, wherein each of the layers has a thickness of from about 1 micron to about 5 mm.

27. The method of claim 25, wherein the layers of reactive components are directly adjacent each other.

28. The method of claim 25, wherein the layers of reactive components are separated from each other.

29. The method of claim 28, wherein the layers of reactive components are separated by at least one layer of inert material.

30. The method of claim 29, wherein the inert material comprises $Al_2O_3$ and/or SiO.

31. The method of claim 1, wherein the reactive material has a porosity of less than about 10 volume percent.

32. The method of claim 1, wherein the reactive material has a porosity of less than about 5 volume percent.

33. The method of claim 1, wherein the reactive material has a porosity of less than about 2 volume percent.

* * * * *